US005107903A

United States Patent [19]

Cinel

[11] Patent Number: 5,107,903

[45] Date of Patent: Apr. 28, 1992

[54] GUIDE BLOCK ARRANGEMENT FOR A WEFT GRIPPER TAPE

[75] Inventor: Luciano Cinel, San Vito di Leguzzano, Italy

[73] Assignee: Nuovopignone - Industrie Meccaniche e Fonderia S.p.A., Florence, Italy

[21] Appl. No.: 606,692

[22] Filed: Oct. 31, 1990

[30] Foreign Application Priority Data

Nov. 3, 1989 [IT] Italy ..... 22254 A/89

[51] Int. Cl.[5] ..... D03D 47/14

[52] U.S. Cl. ..... 139/449; 226/76; 474/140

[58] Field of Search ..... 226/76, 82, 86; 474/140; 139/449

[56] References Cited

U.S. PATENT DOCUMENTS 4,079,633 3/1978 Cheema et al. ..... 226/76 X 4,344,466 8/1982 Hasegawa et al. ..... 139/449

FOREIGN PATENT DOCUMENTS 2545508 5/1984 France ..... 139/449

*Primary Examiner*—Andrew M. Falik

*Attorney, Agent, or Firm*—Morgan & Finnegan

[57] ABSTRACT

A tape drive system for the weft gripper of a shuttleless loom which uses a plastically undeformable tape formed of composite laminate layers containing rigid fibers. The tape is driven by a sprocket engaging perforations provided along the tape and the engagement is being ensured by two shoulder blocks. Additionally the tape is provided with a permanent magnet at that end carrying said weft gripper cooperating with a metal plate extending along the whole or at least part of a tape travel track.

3 Claims, 1 Drawing Sheet

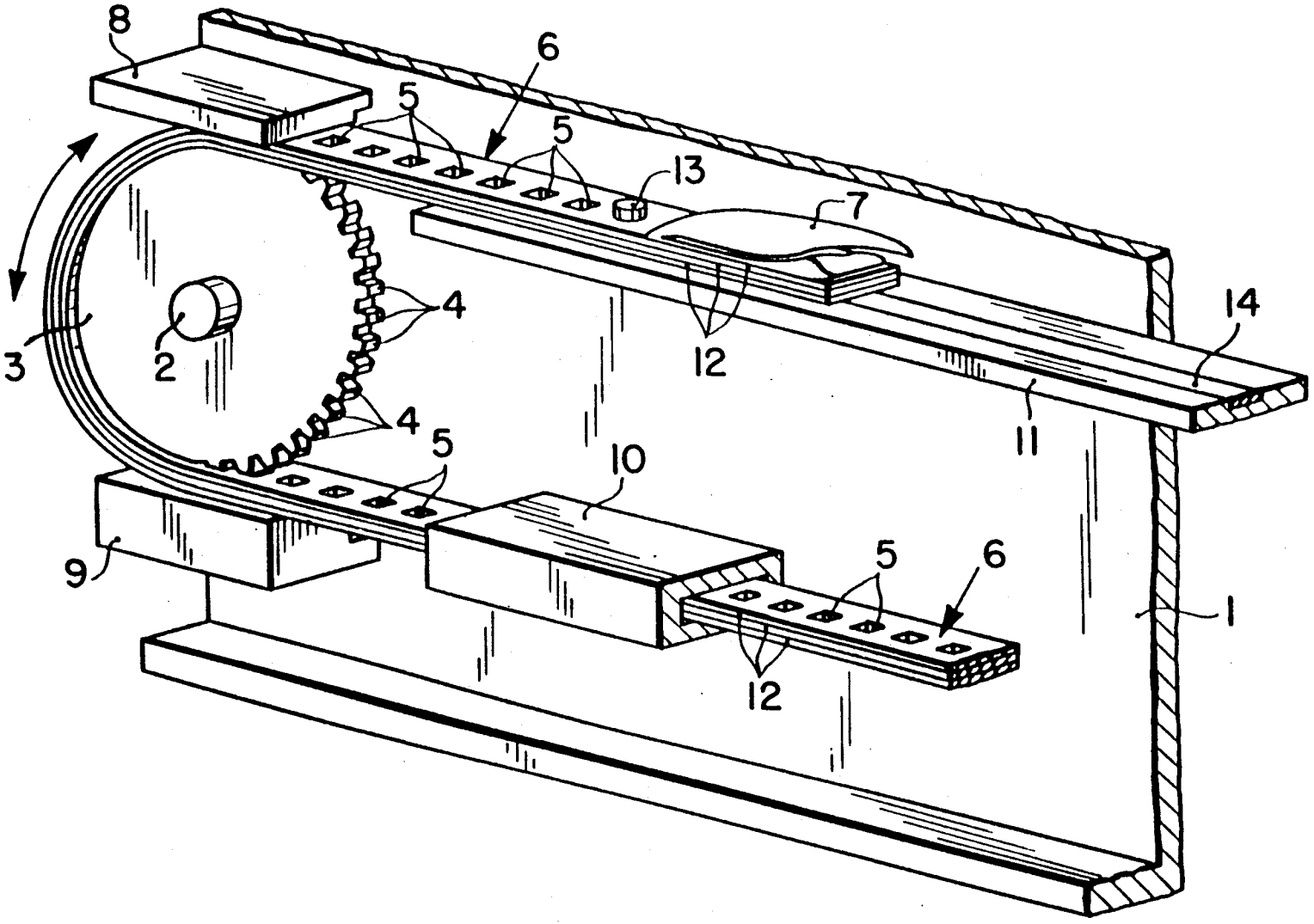
14
1
11
6
5
12
7
13
10
4
2
8
9
3

GUIDE BLOCK ARRANGEMENT FOR A WEFT GRIPPER TAPE

This invention relates to a new tape drive system for the weft gripper of a shuttleless loom which is efficient and simply constructed and therefore of low cost. It is also extremely lightweight and therefore of negligible inertia, so as to enable the high operating rates required of modern looms to be obtained without loss of tape rectilinearity and without wear due to sliding.

BACKGROUND OF THE INVENTION

In the current state of the art the weft gripper of a shuttleless loom is generally driven by a flexible polyester tape driven with reciprocating motion by a drive sprocket.

Such a flexible tape would however undergoes permanent deformation during operation with consequent loss of rectilinearity. It is essential to maintain rectilinearity to allow even slow transfer of the weft yarn between the grippers at the center of the shed. It has been found necessary to guide the tape along its entire travel by guide blocks which are positioned in staggered arrangement along the two sides of the tape and which comprise opposing C-shaped grooves in which the tape slides.

The guide blocks create a disturbance for the warp yarns. The warp yarns can undergo damage especially in the case of high density weaves. These guide blocks by their very pressure give rise to the danger of undesirable lines appearing on the forming fabric causing color nuances due to the rubbing of said blocks against the warp yarns. There is also the further drawback of tape wear by mechanical sliding between the grooves in the blocks.

In order to dispense with said guide blocks and hence obviate said drawbacks, it is necessary to replace the flexible polyester tapes with plastically indeformable tapes, i.e. laminated layer tapes containing rigid carbon, Kevlar, glass or other fibers. Such tapes cannot undergo permanent deformation and therefore do not lose their rectilinearity by repeated winding onto and unwinding from the respective drive sprocket.

A tape drive system for the weft gripper in a shuttleless loom which uses a rigid tape is already known.

This known system uses a non-toothed drive wheel about which the plastically indeformable tape is wound with its end fixed to the wheel periphery. This tape is made to perfectly adhere to the wheel periphery, against the effect of the arising centrifugal force, by an auxiliary pressing cable which passes about two idle pulleys and has its ends fixed to the wheel periphery.

Although this solution is effective, it is, however, evidently of very complicated structure and therefore costly. In addition, it has a certain inertia due to the masses in motion, thus limiting the maximum obtainable operating speed.

The object of the present invention is to obviate said drawbacks by providing a tape drive system for the weft gripper of a shuttleless loom which is extremely light and therefore of negligible inertia, and which, in addition, is simply constructed and thus of low cost.

SUMMARY OF THE INVENTION

The present invention uses a plastically undeformable tape formed of composite laminate layers containing rigid fibres of carbon, Kevlar, glass or other type, which is provided along its length with perforations arranged to cooperate with the teeth of a drive sprocket. The engagement between the tape and sprocket is ensured by two shoulder blocks disposed in diametrically opposite positions at those points on the sprocket from which the tape extends horizontally.

The extreme simplicity of the arrangement itself underlines its advantages. In addition, to prevent the plastically undeformable tape from undergoing deflection during its travel, a further aspect of the present invention provides means for correctly positioning the tape along its travel track without the aid of mechanical guides. This means comprises a metal plate which extends along the whole or at least part of the tape travel track and cooperates with at least one permanent magnet fixed to that end of the tape which carries the weft gripper.

In this manner the magnetic attraction between the magnet and metal plate keeps the end of the tape adhering to the plate and prevents any curving of the tape.

The invention will be more apparent from the description given hereinafter with reference to the accompanying drawing which shows a preferred embodiment by way of non-limiting example in that technical, technological or constructional modifications can be made thereto but without leaving the scope of the present invention.

BRIEF DESCRIPTION OF THE DRAWING

The FIGURE represents a partial perspective view of the tape drive system for the weft gripper of a shuttleless loom constructed in accordance with the invention.

DETAILED DESCRIPTION OF THE INVENTION

In the FIGURE the reference numeral 1 indicates the loom body on which the drive sprocket 3 is mounted by means of the shaft 2. Said sprocket 3, is driven with reciprocating motion by members not shown in the FIGURE comprises toothing 4 which engages with perforations 5 provided along the drive tape 6 for the weft gripper 7, which is fixed to one end of the tape. Said tape 6, is kept engaged with the sprocket 3 by the two shoulder blocks 8 and 9 respectively. Blocks 8 and 9 are fixed to the loom body 1 in diametrically opposite positions about the sprocket 3. Tape 6 extends from sprocket 3 and is horizontally supported below by the guide block 10 and above by its travel track 11. Tape 6 is a substantially plastically undeformable tape formed of composite laminate layers 12 containing rigid fibers of carbon, Kevlar, glass or other type and is also provided at that end supporting the gripper 7 with a permanent magnet 13 which cooperates with a metal plate 14 extending along all or at least part of said travel track 11.

I claim:

1. In combination with a weft gripper of a shuttleless loom, a tape drive system comprising a tape to one end of which said weft gripper is fixed, and a drive sprocket for said tape which passes about it, said tape being a plastically undeformable tape formed of composite laminate layers containing rigid fibers said tape having along its length perforations which are arranged to cooperate with teeth of said drive sprocket, a engagement between the sprocket and tape is ensured by two shoulder blocks which are disposed in diametrically opposite positions at those points on the sprocket from which the tape extends horizontally, and means for correctly positioning the tape along a tape travel track without the aid of mechanical guides.

2. A tape drive system as claimed in claim 1, wherein said means for correctly positioning the tape along its travel track without the aid of mechanical guides comprises a metal plate extending along the whole or at least part of said travel track which cooperates with at least one permanent magnet fixed to an end of the tape which carries the weft gripper.

3. A tape drive system as claimed in claim 1, wherein the rigid fibers are carbon, Kevlar or glass.

* * * * *

UNITED STATES PATENT AND TRADEMARK OFFICE

CERTIFICATE OF CORRECTION

PATENT NO. : 5,107,903

DATED : April 28, 1992

INVENTOR(S) : Hans P. Hopper

It is certified that error appears in the above-identified patent and that said Letters Patent is hereby corrected as shown below:

Column 1, line 36 - delete "seal" and substitute therefore -- sea --

Column 8, line 13 - insert -- 51 -- following "profile".

Column 14, line 14 - delete "internal" and substitute therefore -- external --

Signed and Sealed this

Twenty-ninth Day of June, 1993

*Attest:*

Michael K. Kirk

MICHAEL K. KIRK

*Attesting Officer*

*Acting Commissioner of Patents and Trademarks*